US011266876B2

(12) United States Patent
Kim et al.

(10) Patent No.: US 11,266,876 B2
(45) Date of Patent: Mar. 8, 2022

(54) ANKLE MUSCLE RESISTANCE-TRAINING APPARATUS

(71) Applicant: NATIONAL REHABILITATION CENTER, Seoul (KR)

(72) Inventors: Hogene Kim, Seoul (KR); Sang Woo Cho, Seoul (KR); Ji Eun Cho, Seoul (KR); Joon Ho Shin, Seoul (KR); Do Hoon Koo, Seoul (KR)

(73) Assignee: National Rehabilitation Center, Seoul (KR)

( * ) Notice: Subject to any disclaimer, the term of this patent is extended or adjusted under 35 U.S.C. 154(b) by 35 days.

(21) Appl. No.: 16/954,954

(22) PCT Filed: Dec. 6, 2018

(86) PCT No.: PCT/KR2018/015410

§ 371 (c)(1),
(2) Date: Jun. 17, 2020

(87) PCT Pub. No.: WO2019/124832

PCT Pub. Date: Jun. 27, 2019

(65) Prior Publication Data

US 2020/0330822 A1 Oct. 22, 2020

(30) Foreign Application Priority Data

Dec. 19, 2017 (KR) ..... 10-2017-0175300

(51) Int. Cl.
*A63B 23/08* (2006.01)
*A63B 21/005* (2006.01)
*A63B 22/06* (2006.01)

(52) U.S. Cl.
CPC ..... *A63B 23/08* (2013.01); *A63B 21/0056* (2013.01); *A63B 22/0605* (2013.01); *A63B 2022/0611* (2013.01)

(58) Field of Classification Search
CPC . A63B 23/08; A63B 21/0056; A63B 22/0605; A63B 2022/0611; A63B 23/085;
(Continued)

(56) References Cited

U.S. PATENT DOCUMENTS

2011/0256983 A1* 10/2011 Malack ..... A63B 23/0405 482/4
2012/0296242 A1* 11/2012 Ochi ..... A61H 1/005 601/5
2015/0328497 A1* 11/2015 Doucot ..... A63B 21/00181 482/146

FOREIGN PATENT DOCUMENTS

JP 2002177353 A 6/2002
JP 2005237762 A 9/2005
(Continued)

*Primary Examiner* — Joshua Lee
(74) *Attorney, Agent, or Firm* — Rabin & Berdo, P.C.

(57) ABSTRACT

The present invention addresses the technical problem of providing an ankle muscle resistance-training apparatus which induces an angle change of the ankle while the ankle is actively moving, and can improve strength of the ankle muscle by applying resistance force to the ankle movement. To this end, the ankle muscle resistance-training apparatus according to the present invention comprises: a support member; a first movement guiding shaft; an intermediate member; a second movement guiding shaft; a foot support; a first resistance force application part; and a second resistance force application part. The first resistance force application part is linked with the first movement guiding shaft and applies resistance force of an adjustable intensity against the active ankle movement of a user made with respect to the first movement guiding shaft in a state in which the foot is placed on the foot support, and the second resistance force application part is linked with the second movement guiding shaft and applies resistance force of an adjustable intensity against the active ankle movement of a user made with
(Continued)

respect to the second movement guiding shaft in the state in which the foot is placed on the foot support.

6 Claims, 7 Drawing Sheets

(58) Field of Classification Search
CPC ..... A63B 2026/006; A63B 2209/00; A63B 2209/08; A63B 21/4047; A63B 21/4049; A63B 21/005; A63B 21/0051; A63B 21/0052; A63B 21/015; A61H 1/02; A61H 1/0214; A61H 2001/0207; A61H 1/0237; A61H 1/0266; A61H 2201/1261; A61H 2201/1207; A61H 2201/1436
See application file for complete search history.

(56) References Cited

FOREIGN PATENT DOCUMENTS

| | | | |
|---|---|---|---|
| KR | 1020100090619 | A | 8/2010 |
| KR | 101796916 | B1 | 11/2017 |
| WO | 2013093787 | A1 | 6/2013 |

* cited by examiner (a)

(b)

ANKLE MUSCLE RESISTANCE-TRAINING APPARATUS

TECHNICAL FIELD

The present disclosure relates to an ankle muscle resistance-training apparatus.

BACKGROUND ART

In general, ankle movement, along with the muscle strength, has an important effect on gait stability. The ankle movements can be summarized as movements occurring in the sagittal plane, the frontal plane, and the transverse plane, and occurs according to the movements of the ankle joint (or talocrural joint), transverse tarsal joint, and subtalar joint.

Damage, impairment, and loss of lower extremity function due to musculoskeletal and central nervous system diseases may lead to a decrease in gait ability or loss, which can be regarded as one of the serious causes of hindering the performance of independent daily living. In particular, in the case of stroke, which is one of the central nervous system diseases, most patients support 61% to 80% of the total body weight with a non-injured lower limb, thus exhibiting asymmetric posture alignment and deterioration of balance ability. Abnormal gait patterns after the stroke include stiff-knee gait during the swing phase, genu recuvatum during the stance phase, reduction of dorsiflexion at the stance phase and excessive plantar flexion during the swing phase, and the like. In addition, gait speed, cadence, and stride length are reduced, and double stance periods are increased, and the standing period of the damaged side is shorter than that of the non-injured side.

Therefore, for the gait rehabilitation of people with central nervous system disorders such as stroke, functional electric stimulation, brace support, and the like are applied, or methods of performing joint movement range exercises by the therapist, stretching exercises, resistance bands, manual ankle trainers, weight-bearing resistance exercises in an upright posture, and so on are clinically used. Furthermore, in order to provide a range of movement of the ankle, an automatic ankle trainer is also used, which includes a rotation shaft corresponding to the ankle joint and driven by a motor. These gait training interventions involving ankles have positive effects such as increased gait stability, gait speed, gait efficiency, and so on.

However, these methods have limitations in improving muscle strength because by these methods, a disabled user with hemiplegia is not allowed to actively move his or her ankle, but is passively provided with a range of movements of the ankle by the therapist, trainer, and the like, and accordingly does not have a resistance force during ankle movement.

DETAILED DESCRIPTION OF THE INVENTION

Technical Problem

The technical problem of the present disclosure is to provide an ankle muscle resistance-training apparatus capable of improving ankle muscle strength by inducing an angle change of an ankle, and also by applying a resistance force to a movement of the ankle during active movement of the ankle.

Technical Solution

In order to achieve the objects described above, an ankle muscle resistance-training apparatus according to an embodiment of the present disclosure is provided, which may include: a support member; a first movement guiding shaft perpendicular to a front-rear direction of the support member and horizontal to a ground; an intermediate member rotatably provided on the support member with respect to the first movement guiding shaft; a second movement guiding shaft perpendicular to the first movement guiding shaft and inclined to the ground; a foot support rotatably provided on the intermediate member with respect to the second movement guiding shaft and inclined with respect to the second movement guiding shaft, and on which a foot of a user is placed; a first resistance force application part linked with the first movement guiding shaft and applying resistance force of an adjustable intensity against the active ankle movement of the user made with respect to the first movement guiding shaft in a state in which the foot is placed on the foot support; and a second resistance force application part linked with the second movement guiding shaft and applying resistance force of an adjustable intensity against the active ankle movement of the user made with respect to the second movement guiding shaft in a state in which the foot is placed on the foot support.

The first resistance force application part may include: a link shaft provided rotatably on the support member and linked with the first movement guiding shaft; a rotating disk provided rotatably on the support member through a first support bracket and linked with the first link shaft; a first brake applying a braking force to the rotating disk using an electromagnet; and a first adjustment switch for adjusting a strength of the electromagnet of the first brake.

The first resistance force application part may further include an one-way bearing supporting any one of the first movement guiding shaft, the link shaft, and the rotating disk such that the resistance force is applied only when the foot support is pressed by an ankle of the user.

The second resistance force application part may include: a center crank wheel linked with the second movement guiding shaft; a first side crank wheel spaced apart from one side of the center crank wheel and rotatably provided on one side of the intermediate member; a first horizontal sliding joint slidably provided on the intermediate member to be slid left and right between the center crank wheel and the first side crank wheel; a first crank arm linking the center crank wheel with the first horizontal sliding joint; a second crank arm linking the first horizontal sliding joint and the first side crank wheel; a second brake applying braking force to the first side crank wheel using an electromagnet; and a second adjustment switch for adjusting a strength of the second brake.

The second resistance force application part may further include: a second side crank wheel spaced apart from the other side of the center crank wheel and rotatably provided on the other side of the intermediate member; a second horizontal sliding joint slidably provided on the intermediate member to be slid left and right between the center crank wheel and the second side crank wheel; a third crank arm linking the center crank wheel with the second horizontal sliding joint; a fourth crank arm linking the second horizontal sliding joint with the second side crank wheel; and a third brake applying a braking force to the second side crank wheel using an electromagnet, in which the second adjustment switch may adjust the strengths of the electromagnets of the second and third brakes together.

The first movement guiding shaft may be provided such that an ankle joint of the user is placed in an axial direction thereof.

The second movement guiding shaft may be provided such that a subtalar joint of the user is placed in an axial direction thereof.

Advantageous Effects

According to an embodiment of the present disclosure, a technical configuration including a support member, a first movement guiding shaft, an intermediate member, a second movement guiding shaft, a foot support, a first resistance force application part, and a second resistance force application part is provided, and it is possible to induce changes in the angle of the ankle normally generated during active walking for those who are unable to smoothly generate ankle movements necessary for walking due to lower limb paralysis or muscle weakness, and also enhance ankle muscle strength by applying a resistance force to the ankle movements.

BEST MODE

Hereinafter, preferred embodiments of the present disclosure will be described in detail with reference to the accompanying drawings, which will be readily apparent to those skilled in the art to which the present disclosure pertains. However, the description proposed herein is just a preferable example for the purpose of illustrations only, and not intended to limit the scope of the invention, so it should be understood that other equivalents and modifications could be made thereto without departing from the scope of the invention.

Figure 1:
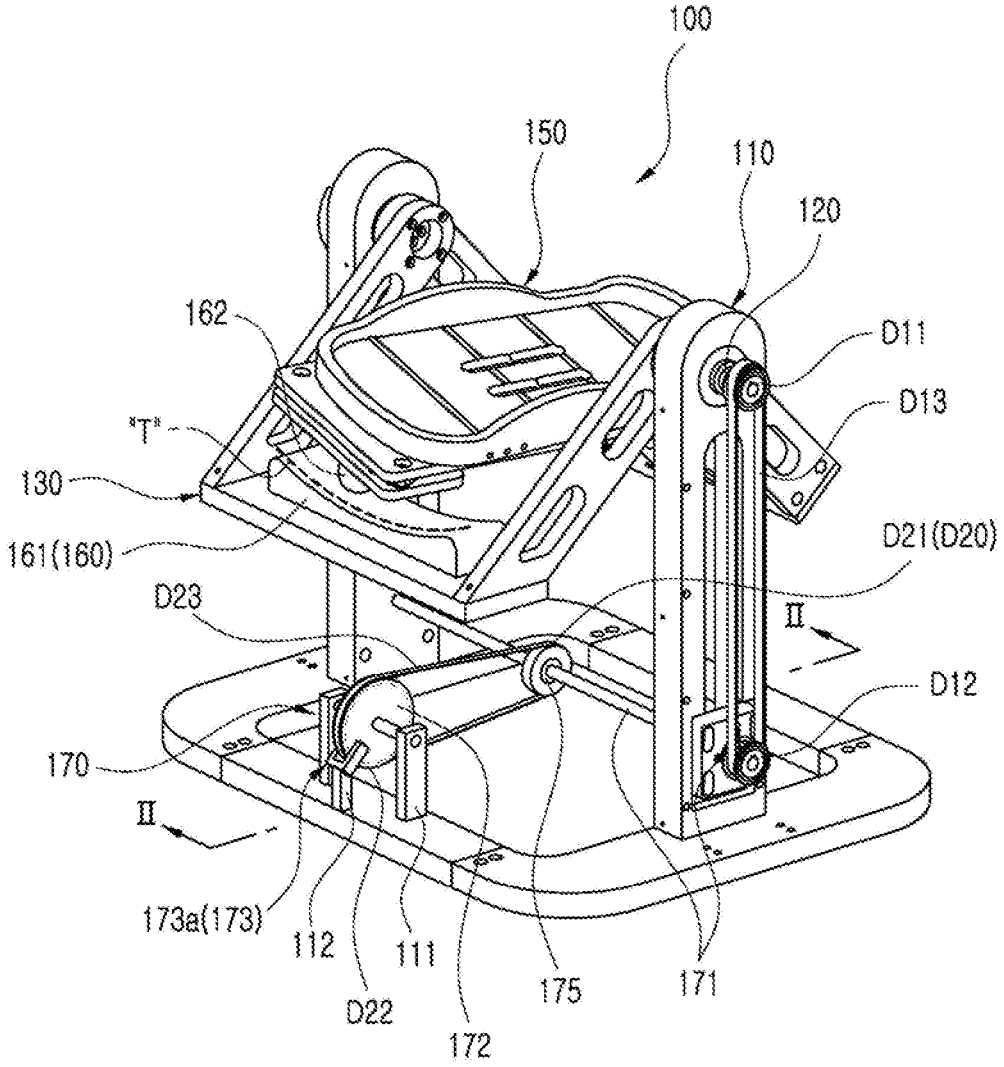
FIG. 1 is a perspective view schematically showing an ankle muscle resistance-training apparatus according to an embodiment of the present disclosure.
Figure 2:
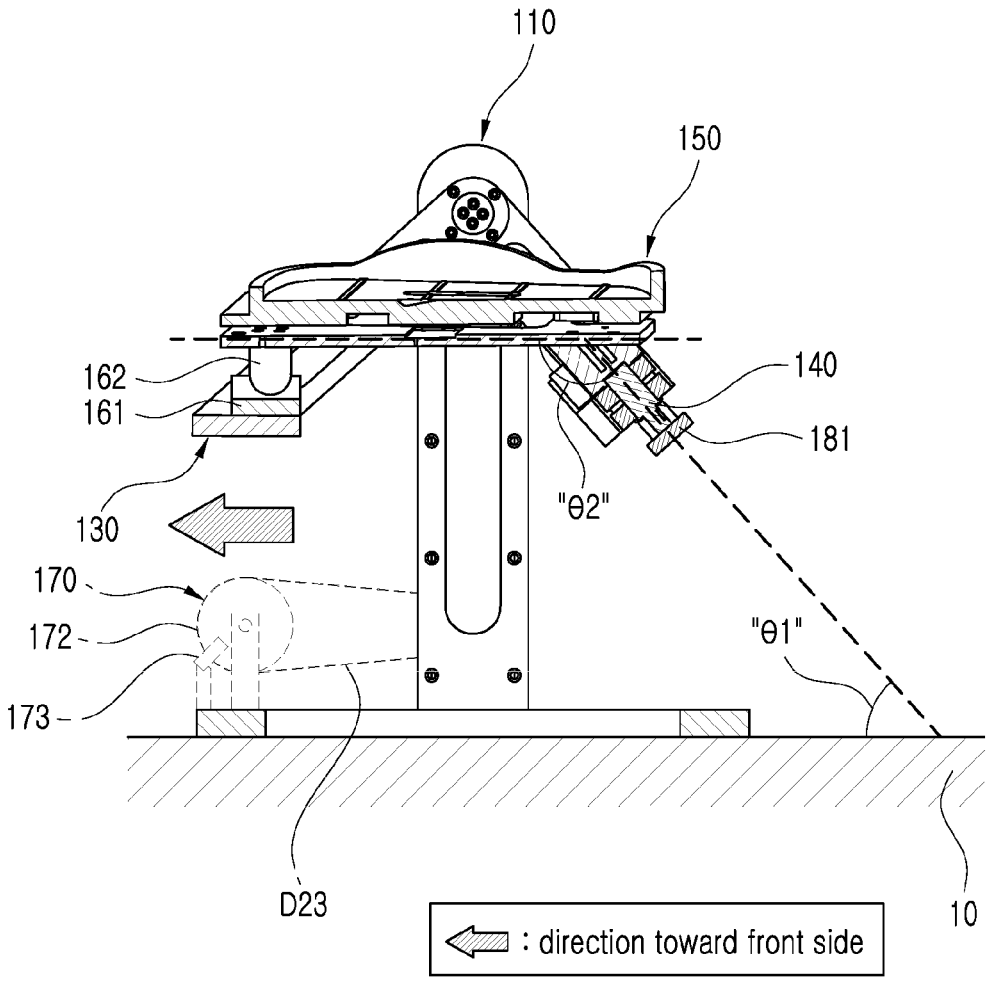
FIG. 2 is a cross-sectional view of the ankle muscle resistance-training apparatus of FIG. 1 taken along line II-II.
Figure 3:
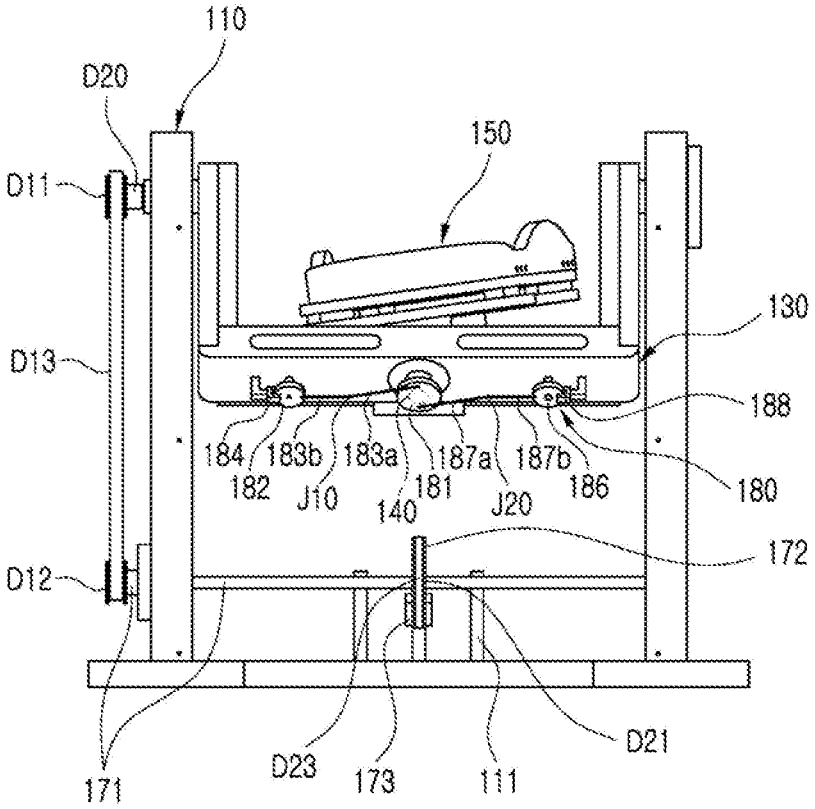
FIG. 3 is a rear view showing the ankle muscle resistance-training apparatus of FIG. 1.

FIG. 1 is a perspective view schematically showing an ankle muscle resistance-training apparatus according to an embodiment of the present disclosure, FIG. 2 is a cross-sectional view of the ankle muscle resistance-training apparatus of FIG. 1 taken along line II-II, and FIG. 3 is a rear view showing the ankle muscle resistance-training apparatus of FIG. 1.

Figure 4:
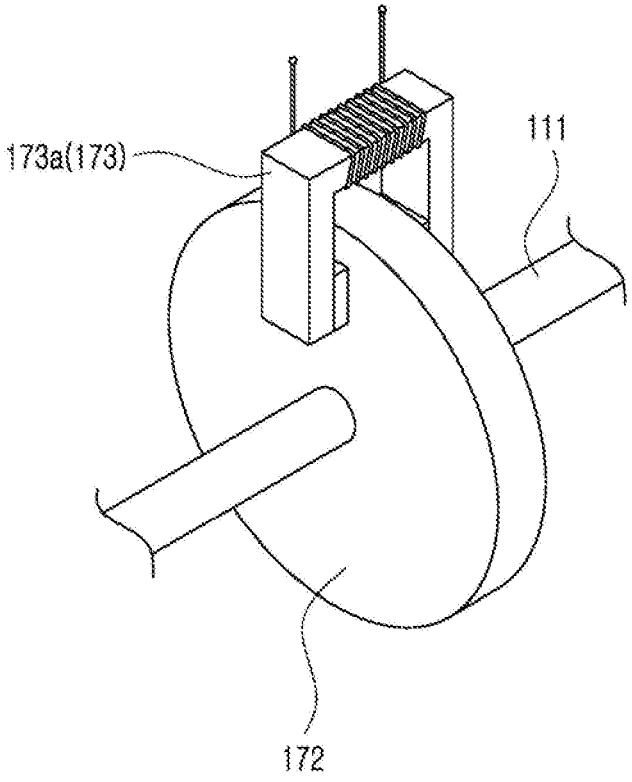
FIG. 4 is a view schematically showing an example of a first brake of a first resistance force application part of the ankle muscle resistance-training apparatus of FIG. 1.
Figure 5:
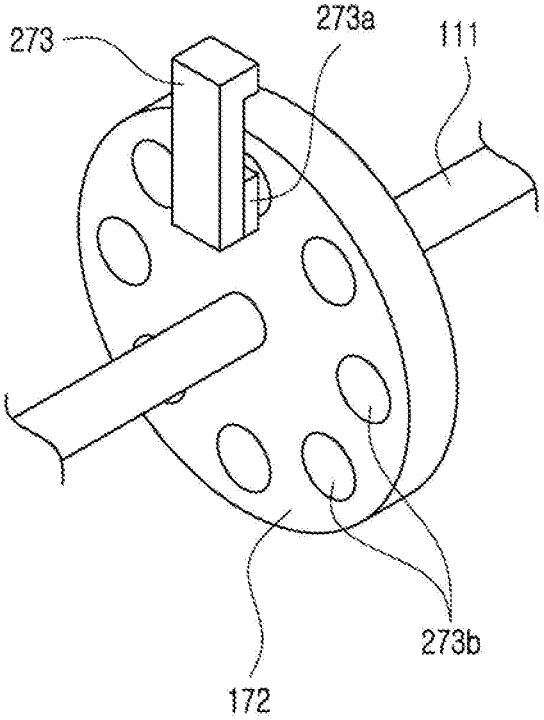
FIG. 5 is a view schematically showing another example of a first brake of a first resistance force application part of the ankle muscle resistance-training apparatus of FIG. 1.
Figure 6:
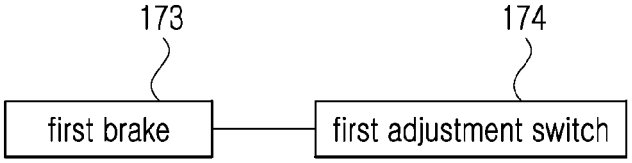
FIG. 6 is a block diagram schematically showing the first brake and a first adjustment switch.

FIG. 4 is a view schematically showing an example of a first brake of a first resistance force application part of the ankle muscle resistance-training apparatus of FIG. 1, FIG. 5 is a view schematically showing another example of a first brake of a first resistance force application part of the ankle muscle resistance-training apparatus of FIG. 1, and FIG. 6 is a block diagram schematically showing the first brake and a first adjustment switch.

Figure 7:
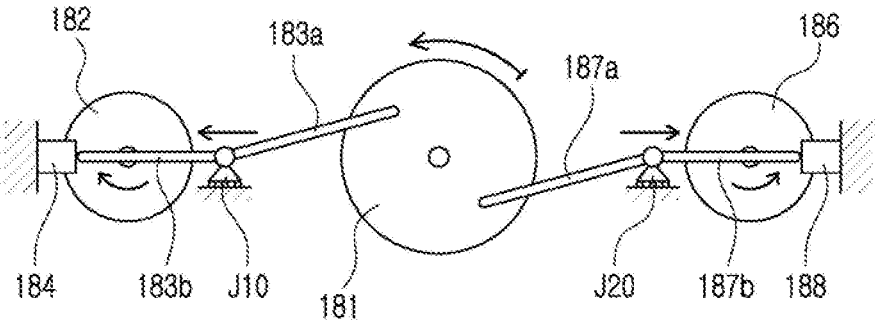
FIG. 7 is a view schematically showing a linked state of a second resistance force application part of the ankle muscle resistance-training apparatus of FIG. 1.
Figure 7:
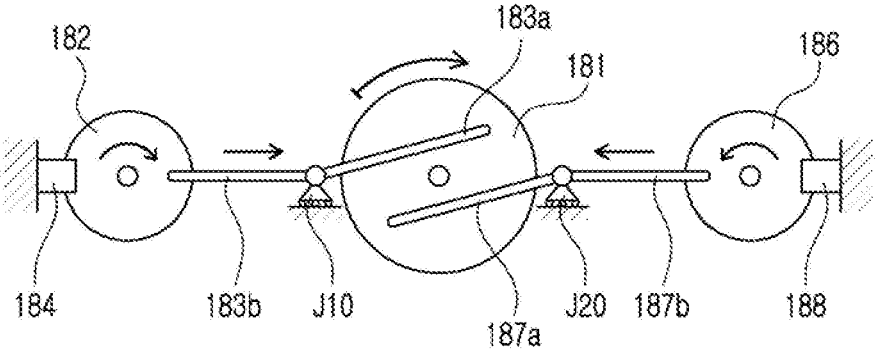
Figure 8:
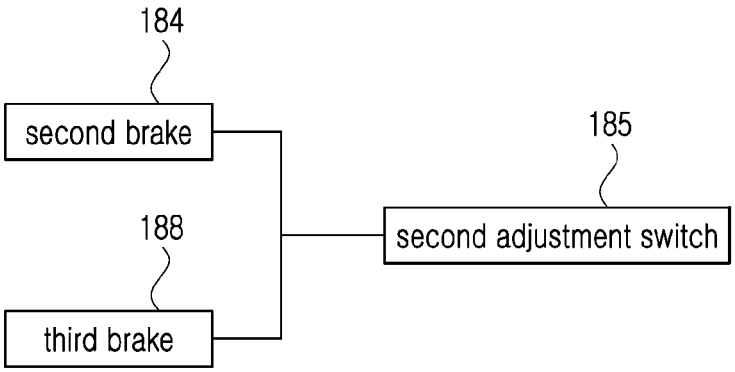
FIG. 8 is a block diagram schematically showing second and third brakes and a second adjustment switch.

FIG. 7 is a view schematically showing a linked state of a second resistance force application part of the ankle muscle resistance-training apparatus of FIG. 1, and FIG. 8 is a block diagram schematically showing second and third brakes and a second adjustment switch.

As shown in FIGS. 1 to 8, the ankle muscle resistance-training apparatus 100 according to an embodiment of the present disclosure includes a support member 110, a first movement guiding shaft 120, an intermediate member 130, a second movement guiding shaft 140, a foot support 150, a first resistance force application part 170, and a second resistance force application part 180. Hereinafter, each of the components will be described in detail with continued reference to FIGS. 1 to 10.

The support member 110 forms a framework of the ankle muscle resistance-training apparatus 100 according to the present disclosure, in which a lower portion is designed so as to be placed on a flat surface such as the ground (see 10 in FIG. 2), and upwardly protruding at both side portions thereof, as shown in FIGS. 1 to 3.

The first movement guiding shaft 120 serves as a hinge of the intermediate member 130 such that the intermediate member 130 is rotated with respect to the support member 110, and as shown in FIG. 1, may be positioned perpendicularly to the front-rear direction of the support member 110, and, as shown in FIGS. 1 and 2, positioned horizontally with respect to the ground (see 10 in FIG. 2). Therefore, the intermediate member 130 may perform a pitch motion with respect to the first movement guiding shaft 120.

In particular, the first movement guiding shaft 120 may be provided such that the ankle joint of the user is positioned in the axial direction thereof.

Accordingly, when the foot of the user is placed on the foot support 150 provided in the intermediate member 130 and rotated with respect to the first movement guiding shaft 120, the foot may be rotated upward (dorsiflexion) or downward (plantarflexion) with respect to the ankle joint, and accordingly, it is possible to assist rehabilitation of those who are unable to smoothly generate the ankle movements necessary for walking due to lower limb paralysis or muscle weakness, by inducing normal angle changes of the ankle with respect to the ankle joint as are generated during walking.

The intermediate member 130 is provided between the support member 110 and the foot support 150 and supports the foot support 150, in which, as shown in FIGS. 1 to 3, the intermediate member 130 is rotatably provided on the support member 110 with respect to the first movement guiding shaft 120 so as to be rotated together with the first movement guiding shaft 120, allowing a front portion of the foot to be rotated upward or downward with respect to the ankle joint.

The second movement guiding shaft 140 serves as a hinge of the foot support 150 such that the foot support 150 is rotated with respect to the intermediate member 130, and as shown in FIG. 2, may be positioned in parallel to the front-rear direction of the intermediate member 130 and positioned with an inclination with respect to the ground 10. Therefore, the intermediate member 130 may approximately perform a roll motion with respect to the first movement guiding shaft 120.

In particular, the second movement guiding shaft 140 may be provided such that the subtalar joint of the user is positioned in the axial direction thereof.

Accordingly, when the foot of the user is placed on the foot support 150 and rotated with respect to the second movement guiding shaft 140, the foot may be rotated left or right with respect to the subtalar joint, and accordingly, it is possible to assist rehabilitation of those who are unable to smoothly generate the ankle movements necessary for walking due to lower limb paralysis or muscle weakness by inducing normal angle changes of the ankle with respect to the subtalar joint as are generated during walking.

The foot support 150 is where the foot of the user is placed, and, as shown in FIG. 2, may be rotatably provided on the intermediate member 130 with respect to the second movement guiding shaft 140 and provided with an inclination with respect to the second movement guiding shaft 140.

In particular, as shown in FIG. 3, the second movement guiding shaft 140 may form an acute angle (θ1) with the ground 10 toward the front direction of the intermediate member 130, and the foot support may form an obtuse angle (θ2) with the second movement guiding shaft 140 toward the front direction of the intermediate member 130. Accordingly, through such inclined structures of the foot support 150 and the second movement guiding shaft 140, the subtalar joint of the foot of the user may be positioned in the axial direction of the second movement guiding shaft 140.

Furthermore, since the subtalar joint is positioned in the axial direction of the second movement guiding shaft 140, when the second movement guiding shaft 140 is rotated, the front end of the foot support 150 may be moved while following a left-and-right trajectory (T in FIG. 1). Specifically, the left-and-right trajectory T may be the trajectory in concave shape that gradually increases in height from its center towards the left and right sides. Therefore, it is possible to assist rehabilitation of those who are unable to smoothly generate the ankle movements necessary for walking due to lower limb paralysis or muscle weakness by inducing more stable angle changes of the ankle with respect to the subtalar joint as are generated during walking.

In addition, the ankle muscle resistance-training apparatus 100 according to the embodiment of the present disclosure described above may further include a left and right guide portion 160, as shown in FIG. 1.

The left and right guide portion 160 is a component that guides a front end of the foot support 150 in accordance with the left-and-right trajectory T while supporting the front end of the foot support 150. For example, the left and right guide portion 160 may include a driven guide member 161 and a driving guide member 162 as shown in FIG. 1. The driven guide member 161 is provided at a front end of the intermediate member 130 and has a concave shape corresponding to the left-and-right trajectory T, and the driving guide member 162 is provided to protrude from the front end of the foot support 150 and is moved while following the left-and-right trajectory T along the driven guide member 161.

Therefore, since a rear end of the foot support 150 is provided on the intermediate member 130 through the second movement guiding shaft 140, and the front end of the foot support 150 is supported by the intermediate member 130 through the left and right guide portion 160, the foot support 150 is supported at both the front end and the rear end thereof, such that the left and right movements of the foot support 150 can be more stably guided with a minimum operation error.

The first resistance force application part 170 is a component for improving the muscle strength of the ankle joint of the user by applying a load while the user is placing his or her foot on the foot support 150 and actively moving the ankle joint, and as shown in FIGS. 1 and 3, may be linked with the first movement guiding shaft 120 and apply a resistance force of an adjustable intensity against the active ankle movement of the user made with respect to the first movement guiding shaft 120.

For example, as shown in FIGS. 1 and 6, the first resistance force application part 170 may include a link shaft 171, a rotating disk 172, a first brake 173, and a first adjustment switch 174. The link shaft 171 may be rotatably provided on the support member 110 and linked with the first movement guiding shaft 120 through a first power transmission unit D10, and the rotating disk 172 may be rotatably provided on the support member 110 through a first support bracket 111 and linked with the first link shaft 171 through a second power transmission unit D20. The first brake 173 may apply a braking force to the rotating disk 172 using an electromagnet, and the first adjustment switch 174 may adjust the strength of the electromagnet of the first brake 173.

As shown in FIGS. 1 and 3, the first power transmission unit D10 may include a first pulley D11 provided on the first movement guiding shaft 120, a second pulley D12 provided on the link shaft 171, and a first belt D13 connecting the first and second pulleys D11 and D12. As another example, although not shown, the first power transmission unit may have a sprocket-chain structure, or a gear assembly structure in which a plurality of gears are engaged.

In addition, as shown in FIG. 1, the second power transmission unit D20 may include a third pulley D21 provided on the link shaft 171, a fourth pulley D22 provided on an outer peripheral surface of the rotating disk 172, and a second belt D23 connecting the third and fourth pulleys D21 and D22. As another example, although not shown, the second power transmission unit may have a sprocket-chain structure, or a gear assembly structure in which a plurality of gears are engaged.

In addition, as shown in FIG. 1, an one-way bearing 175 may be provided between the link shaft 171 and the third pulley D21 such that resistance force is applied only when the foot support 150 is pressed with the ankle of the user. As another example, although not shown, such an one-way bearing may be provided between the first movement guiding shaft 120 and the first pulley D11, and provided between the rotating disk 172 and a shaft of the first support bracket 111.

In addition, as shown in FIGS. 1 and 4, the first brake 173 may be provided on the support member 110 through a second support bracket (112 of FIG. 1), and it may be a first eddy current brake 173*a* that applies magnetic force of different polarities to the rotating disk 172 disposed therebetween. In this case, the rotating disk 172 may be formed of a conductive material such as aluminum such that the eddy current can be induced in the rotating disk 172 according to the relative motion between the first eddy current brake 173*a* and the electromagnet. Accordingly, the intensity of the resistance force applied to the first movement guiding shaft 120 may be adjusted by adjusting the strength of the electromagnet of the first eddy current brake 173*a* through the first adjustment switch 174 formed of a variable resistor or the like.

As another example, as shown in FIG. 5, the first brake 273 may include an electromagnet 273*a* provided in the second support bracket (see 112 in FIG. 1) and a plurality of permanent magnets 273*b* arranged on the rotating disk 172 to correspond to the electromagnet 273*a* and having different polarity from the electromagnet 273*a*. Accordingly, the intensity of the resistance force applied to the first movement guiding shaft 120 may be adjusted by adjusting the strength of the electromagnet 273*a* through the first adjustment switch 174 formed of a variable resistor or the like.

The second resistance force application part 180 is a component for improving the muscle strength of the subtalar joint of the user by applying a load while the user is placing his or her foot on the foot support 150 and actively moving the subtalar joint, and as shown in FIGS. 3 and 7, may be linked with the second movement guiding shaft 140 and apply a resistance force of an adjustable intensity against the active ankle movement of the user made with respect to the second movement guiding shaft 140.

For example, as shown in FIGS. 3, 7, and 8, the second resistance force application part 180 may include a center crank wheel 181, a first side crank wheel 182, a first horizontal sliding joint J10, a first crank arm 183*a*, a second crank arm 183*b*, a second brake 184, and a second adjustment switch 185. The center crank wheel 181 may be coupled to and linked with the second movement guiding shaft 140, and the first side crank wheel 182 may be spaced apart from one side of the center crank wheel 181 and rotatably provided on one side of the intermediate member 130, and the first horizontal sliding joint J10 may be slidably provided on the intermediate member 130 so as to be slid left and right between the center crank wheel 181 and the first side crank wheel 182. The first crank arm 183*a* may link the center crank wheel 181 with the first horizontal sliding joint J10, and the second crank arm 183*b* may link the first horizontal sliding joint J10 with the first side crank wheel 182. The second brake 184 may apply a braking force to the first side crank wheel 182 using an electromagnet, and the second adjustment switch 185 may adjust the strength of the second brake 184.

Furthermore, the second brake 184 may take any of the two embodiments described above with respect to the first brake 173, and since these two embodiments have been described above, the detailed description thereof will be omitted. Note that, among the two embodiments described above, when the first eddy current brake (see 173 of FIG. 4) is employed as the second brake 184, the first side crank wheel 182 may be formed of a conductive material such as aluminum. Accordingly, the intensity of the resistance force applied to the second movement guiding shaft 140 may be adjusted by adjusting the strength of the electromagnet of the second brake 184 through the second adjustment switch 185 formed of a variable resistor or the like.

In addition, as shown in FIGS. 3, 7, and 8, the second resistance force application part 180 may further include a second side crank wheel 186, a second horizontal sliding joint J20, a third crank arm 187*a*, a fourth crank arm 187*b*, and a third brake 188 for balance of the force applied to the second movement guiding shaft 120 directions through first and second horizontal sliding joints J10 and J20 and four crank arms 183*a*, 183*b*, 187*a*, and 187*b*. In addition, as shown in FIG. 7, the first side crank wheel 182 may be continuously rotated in a first direction, and the second side crank wheel 186 may be continuously rotated in a second direction opposite to the first direction.

The second side crank wheel 186 may be spaced apart from the other side of the center crank wheel 181 and rotatably provided on the other side of the intermediate member 130, and the second horizontal sliding joint J20 may be slidably provided on the intermediate member 130 so as to be slid left and right between the center crank wheel 181 and the second side crank wheel 162. The third crank arm 187*a* may link the center crank wheel 181 with the second horizontal sliding joint J20, and the fourth crank arm 187*b* may link the second horizontal sliding joint J20 with the second side crank wheel 186. The third brake 188 may apply a braking force to the second side crank wheel 186 using an electromagnet, and in particular, may be adjusted to the same strength as the second brake 184 described above by the second adjustment switch 185 described above for balance of the left and right forces. In addition, as shown in FIG. 7, the first and second side crank wheels 182 and 186 may maintain the balance of left and right moments while being rotated in opposite directions through first and second horizontal sliding joints J10 and J20 and four crank arms 183*a*, 183*b*, 187*a*, and 187*b*. In addition, as shown in FIG. 7, the first side crank wheel 182 may be continuously rotated in a first direction, and the second side crank wheel 186 may be continuously rotated in a second direction opposite to the first direction.

Furthermore, the third brake 188 may take any of the two embodiments described above with respect to the first brake 173, and since these two embodiments have been described above, the detailed description thereof will be omitted. Note that, among the two embodiments described above, when the first eddy current brake (see 173 of FIG. 4) is employed as the third brake 188, the second side crank wheel 186 may be formed of a conductive material such as aluminum. Accordingly, the intensity of the resistance force applied to the second movement guiding shaft 140 may be adjusted by adjusting the strength of the electromagnet of the third brake 188 through the second adjustment switch 185 formed of a variable resistor or the like.

What is claimed is:

1. An ankle muscle resistance-training apparatus, comprising:

a support member;

a first movement guiding shaft perpendicular to a front-rear direction of the support member and horizontal to a ground;

an intermediate member rotatably provided on the support member with respect to the first movement guiding shaft;

a second movement guiding shaft perpendicular to the first movement guiding shaft and inclined to the ground;

a foot support rotatably provided on the intermediate member with respect to the second movement guiding shaft and inclined with respect to the second movement guiding shaft, and configured to receive a foot of a user;

a first resistance force application part linked with the first movement guiding shaft and applying a resistance force of adjustable intensity against the active ankle movement of the user made with respect to the first movement guiding shaft in a state in which the foot is placed on the foot support; and a second resistance force application part linked with the second movement guiding shaft and applying a resistance force of adjustable intensity against the active ankle movement of the user made with respect to the second movement guiding shaft in a state in which the foot is placed on the foot support, wherein the second resistance force application part includes:

a center crank wheel linked with the second movement guiding shaft;

a first side crank wheel spaced apart from one side of the center crank wheel and rotatably provided on one side of the intermediate member;

a first horizontal sliding joint slidably provided on the intermediate member to be slid left and right between the center crank wheel and the first side crank wheel;

a first crank arm linking the center crank wheel with the first horizontal sliding joint;

a second crank arm linking the first horizontal sliding joint and the first side crank wheel;

a second brake applying braking force to the first side crank wheel using an electromagnet; and a second adjustment switch configured to adjust a strength of the second brake.

2. The ankle muscle resistance-training apparatus according to claim 1, wherein the first resistance force application part includes:

a link shaft provided rotatably on the support member and linked with the first movement guiding shaft;

a rotating disk, formed of a conductive material, that is rotatably provided on the support member through a first support bracket and is linked with the link shaft;

a first brake applying a braking force to the rotating disk using an electromagnet; and a first adjustment switch configured to adjust a strength of the electromagnet of the first brake.

3. The ankle muscle resistance-training apparatus according to claim 2, wherein the first resistance force application part further includes a one-way bearing supporting any one of the first movement guiding shaft, the link shaft, and the rotating disk such that the resistance force is applied only when the foot support is pressed by an ankle of the user.

4. The ankle muscle resistance-training apparatus according to claim 1, wherein the second resistance force application part includes:

a second side crank wheel spaced apart from the other side of the center crank wheel and rotatably provided on the other side of the intermediate member;

a second horizontal sliding joint slidably provided on the intermediate member to be slid left and right between the center crank wheel and the second side crank wheel;

a third crank arm linking the center crank wheel with the second horizontal sliding joint;

a fourth crank arm linking the second horizontal sliding joint with the second side crank wheel; and a third brake applying a braking force to the second side crank wheel using an electromagnet, wherein the second adjustment switch is configured to adjust the strengths of the electromagnets of the second and third brakes together.

5. The ankle muscle resistance-training apparatus according to claim 1, wherein the first movement guiding shaft is configured to position an ankle joint of a user in an axial direction thereof.

6. The ankle muscle resistance-training apparatus according to claim 1, wherein the second movement guiding shaft is configured to position a subtalar joint of a user in an axial direction thereof.

* * * * *